US008647213B2

(12) United States Patent
Stromberg et al.

(10) Patent No.: US 8,647,213 B2
(45) Date of Patent: Feb. 11, 2014

(54) APPARATUS FOR A PLAYGROUND BOULDERING SLIDE

(75) Inventors: Brian C. Stromberg, Ogden, UT (US); Greg M. Pickett, Ogden, UT (US)

(73) Assignee: Spectrum Sports International, Hyde Park, UT (US)

( * ) Notice: Subject to any disclaimer, the term of this patent is extended or adjusted under 35 U.S.C. 154(b) by 192 days.

(21) Appl. No.: 13/027,182

(22) Filed: Feb. 14, 2011

(65) Prior Publication Data

US 2011/0201435 A1 Aug. 18, 2011

Related U.S. Application Data

(60) Provisional application No. 61/304,016, filed on Feb. 12, 2010.

(51) Int. Cl.
*A63G 21/04* (2006.01)
*A63B 9/00* (2006.01)

(52) U.S. Cl.
USPC ..... 472/116; 482/35

(58) Field of Classification Search
USPC ..... 472/116, 117, 128; 482/35–37
See application file for complete search history.

(56) References Cited

U.S. PATENT DOCUMENTS

| | | | | | |
|---|---|---|---|---|---|
| D223,460 | S * | 4/1972 | Ahrens | D21/820 |
| 4,546,965 | A | 10/1985 | Baxter et al. | |
| 5,453,055 | A * | 9/1995 | van Huystee | 472/116 |
| 5,816,980 | A * | 10/1998 | Myszka et al. | 482/35 |
| 7,878,877 | B2 * | 2/2011 | Scherba | 446/220 |
| 2007/0167246 | A1 * | 7/2007 | McKee et al. | 472/116 |

* cited by examiner

*Primary Examiner* — Kien Nguyen
(74) *Attorney, Agent, or Firm* — Kunzler Law Group

(57) ABSTRACT

An apparatus is disclosed for climbing and sliding, including a first wall having a first interior surface and a first exterior climbing surface. The apparatus includes a second wall having a second interior surface and a second exterior climbing surface. The apparatus includes a slide having an upper end, a lower end, and a sliding surface descending between the first wall and the second wall. The sliding surface connects to the first interior surface and to the second interior surface. The apparatus includes a plurality of climbing holds. The plurality of climbing holds is secured to the first exterior climbing surface and to the second exterior climbing surface.

20 Claims, 11 Drawing Sheets

APPARATUS FOR A PLAYGROUND BOULDERING SLIDE

CROSS-REFERENCES TO RELATED APPLICATIONS

This application claims the benefit of U.S. Provisional Patent Application No. 61/304,016 entitled "APPARATUS FOR A PLAYGROUND BOULDERING SLIDE" and filed on Feb. 12, 2010 for BRIAN C. STROMBERG et al., which is incorporated herein by reference.

FIELD OF THE INVENTION

This invention relates to playground slides and more particularly relates to a combination climbing wall and slide.

BACKGROUND

Many playgrounds include slides for children. However, children often are exposed to dangerous heights while climbing, entering the slide, and sliding on the slide. Another form of recreation is climbing walls. Climbing walls are often free-standing or are part of a playground apparatus. For a playground owner to include both slides and climbing walls often takes up a lot of space and also can be expensive.

SUMMARY

From the foregoing discussion, it should be apparent that a need exists for an apparatus that combines climbing walls and slides. Beneficially, such an apparatus, system, and method would include a slide that goes through a structure that includes climbing wall where the slide is safer than traditional open slides and the apparatus takes up less space than playground equipment with traditional slides and climbing walls.

The present invention has been developed in response to the present state of the art, and in particular, in response to the problems and needs in the art that have not yet been fully solved by currently available climbing walls and slides. Accordingly, the present invention has been developed to provide an apparatus for climbing and sliding that overcome many or all of the above-discussed shortcomings in the art.

The apparatus includes a first wall having a first interior surface and a first exterior climbing surface. The apparatus may include a second wall having a second interior surface and a second exterior climbing surface. The apparatus may also include a slide having an upper end, a lower end, and a sliding surface that descends between the first wall and the second wall. The sliding surface connects to the first interior surface and to the second interior surface. The apparatus may include a plurality of climbing holds being secured to the first exterior climbing surface and to the second exterior climbing surface.

In one embodiment, the apparatus includes a top cover where the top cover has a third interior surface facing inward towards the sliding surface and a top exterior surface facing outward away from the sliding surface. In one embodiment, the top cover connects to the first wall and to the second wall, covering at least a portion of the slide. In a further embodiment, the top exterior surface of the top cover includes a portion of the plurality of climbing holds. In another embodiment, the top cover covers the slide forming a tunnel between the first wall and second wall and beneath the top cover. In another embodiment, the top cover covers the slide except a portion of the slide at the upper end used to mount the slide just prior to sliding down the slide.

In one embodiment, the apparatus includes an access mechanism that aids a user in accessing the upper end of the slide. The access mechanism may include, in various embodiments, one or more of the following: a plurality of climbing holds on a climbing surface, a ladder, a plurality of steps, a rope, a pole, a cargo net, and a rope ladder. In another embodiment the slide curves between the upper end and the lower end of the slide. In another embodiment a tunnel passes under the slide connecting the first wall and the second wall.

In a further embodiment, the apparatus may include a securing means for securing each climbing hold of the plurality of climbing holds to the first exterior climbing surface and the second exterior climbing surface. A securing means adjacent to where a slider passes the first wall and second wall is internal to the first wall or to the second wall or extends past the first interior surface or second interior surface so that a slider is not exposed to edges of the securing means when sliding past the securing means. In various embodiments, the securing means includes one or more of the following: a t-nut, a screw, a bold, and a protective covering for preventing access to the securing means from the first interior surface and the second interior surface.

The apparatus of the first and second wall may include a wooden sheet, a metal sheet, a plastic wall, and a composite wall, a ceramic wall, a concrete wall, and/or a cinderblock wall. In one embodiment the slide includes two or more slides, where the two or more slides are between the first wall and second wall. In another embodiment, the apparatus includes a third wall with an exterior climbing surface. The third wall, in various embodiments, may connect to the first wall and second wall, may connect to a top cover, may provide an access mechanism to aid a user in accessing the upper end of the slide, and may connect to two or more slides.

In one embodiment the first wall and second wall span at least a horizontal length between the upper end of the slide and the lower end of the slide. In another embodiment, the first wall and second wall span at least a vertical height between the upper end of the slide and the lower end of the slide. In another embodiment the first wall and second wall are substantially rectangular and substantially cover the slide. In another embodiment, the first wall and the second wall provide structural support for the slide. In another embodiment, the first interior surface and the second interior surface include a texture that simulates a tunnel through earth material.

Another apparatus for recreation includes a first wall having a first interior surface and a first exterior climbing surface, and a second wall having a second interior surface and a second exterior climbing surface. The apparatus may include a slide having an upper end, a lower end, and a sliding surface descending between the first wall and the second wall, where the sliding surface connects to the first interior surface and to the second interior surface. The apparatus may include a top cover having a third interior surface facing inward towards the sliding surface and a top exterior surface facing outward away from the sliding surface. The top cover connects to the first wall and to the second wall and the top cover covers at least a portion of the slide, where the top cover covers the slide forming a tunnel between the first wall and second wall and beneath the top cover. The apparatus may include a plurality of climbing holds. The plurality of climbing holds is secured to at least the first exterior climbing surface and to the second exterior climbing surface.

Another apparatus includes a first wall having a first interior surface and a first exterior climbing surface, and a second wall having a second interior surface and a second exterior climbing surface. The apparatus may include a slide having an upper end, a lower end, and a sliding surface descending between the first wall and the second wall, where the sliding surface connects to the first interior surface and to the second interior surface. The apparatus may include a top cover having a third interior surface facing inward towards the sliding surface and a top exterior surface facing outward away from the sliding surface. The top cover connects to the first wall and to the second wall. For the apparatus, the top cover covers at least a portion of the slide, where the top cover covers the slide forming a tunnel between the first wall and second wall and beneath the top cover.

The apparatus may include a plurality of climbing holds, where each of climbing holds is secured to the first exterior climbing surface, to the second exterior climbing surface, or to the top cover. The apparatus may include an access mechanism that aids a user in accessing the upper end of the slide. The access mechanism may include one or more of the following: climbing holds on a climbing surface, a ladder, a plurality of steps, a rope, a pole, a cargo net, and a rope ladder.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Children love playgrounds at parks. The opportunity to swing, descend rapidly down a slide, and spin around on playground equipment thrills children and provides them with vital exercise. Further, playground equipment can help children learn the skills that will increase their enjoyment of the world as they grow up. One piece of playground equipment that helps fulfill these purposes is bouldering walls. A bouldering wall gives children the opportunity for exercise, and the ability to practice skills that can help them enjoy the great outdoors later in life. Therefore, the following disclosure shows an apparatus for a playground bouldering slide that saves playground space while allowing children to exercise and develop bouldering skills.

Figure 1A:
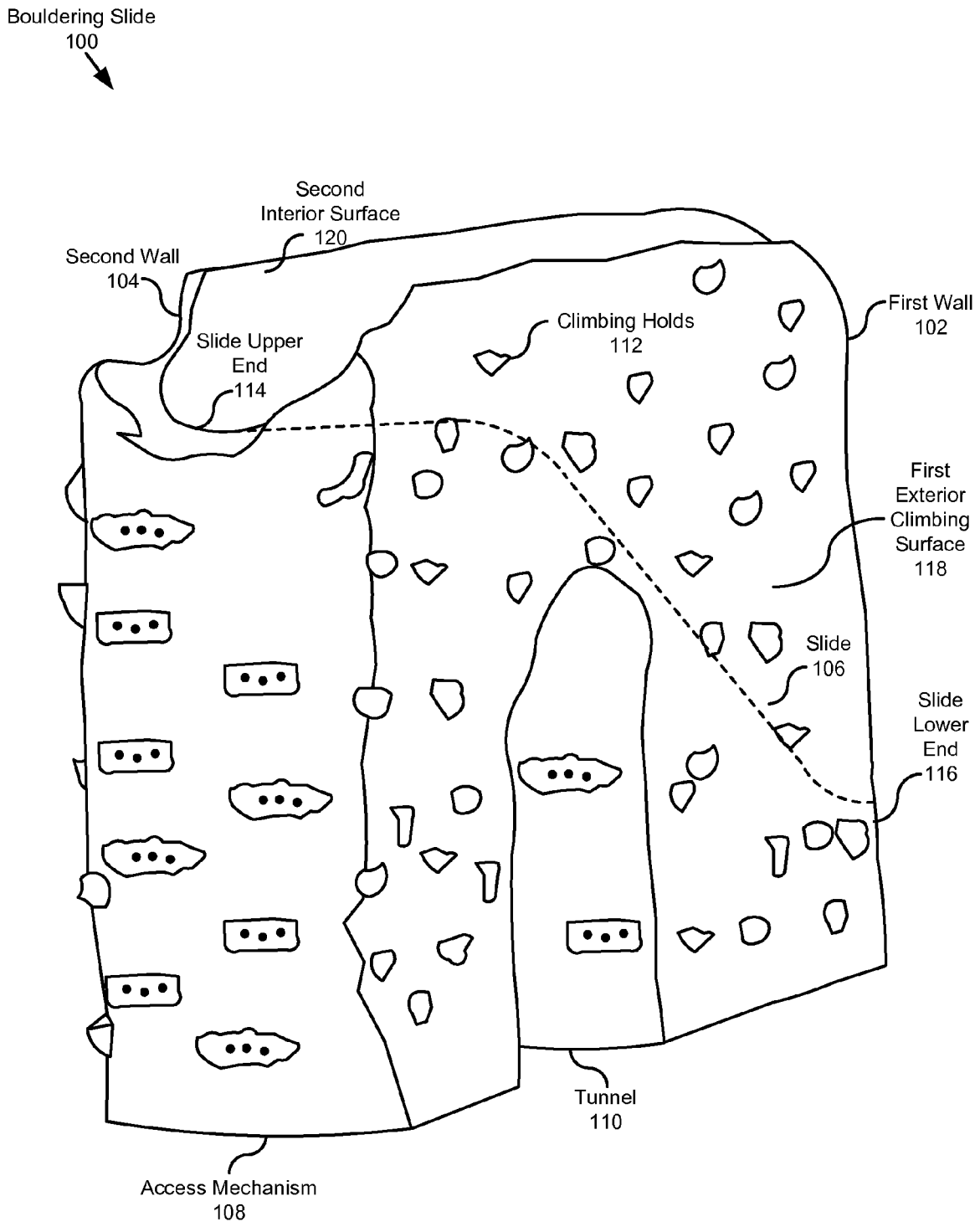
FIG. 1A illustrates one embodiment of a bouldering slide in accordance with the present invention.

FIG. 1A depicts one embodiment of a bouldering slide 100. The bouldering slide 100 may include a first wall 102, a second wall 104, a slide 106, an access mechanism 108, a tunnel 110, and climbing holds 112. The first wall 102 may further include a first exterior climbing surface 118. The second wall 104 may also include a second interior surface 120. The slide 106 may include a slide upper end 114 and a slide lower end 116.

In certain embodiments, a slide 106 may include a sliding surface that descends between the first wall 102 and the second wall 104. For instance, the slide 106 may have a slide upper end 114 where a user may sit and go down the slide 106 between the first wall 102 and the second wall 104. After the user reaches the slide lower end 116, the user may exit the bouldering slide 100. Further, several climbing holds 112 may be secured to the first exterior climbing surface 118 and the second exterior climbing surface (not shown in FIG. 1A, but described in subsequent figures) of the second wall 102. The climbing holds 112 may allow a user to climb on the first wall 102 and the second wall 104.

In at least one embodiment, the first wall 102 and the second wall 104 may span the vertical height of the slide 106 between the slide upper end 114 and the slide lower end 116 to form a substantially rectangular climbing wall that substantially covers the sides of the slide 106. For example, when the slide upper end is eight feet above the ground, the first wall 102 and the second wall 104 may extend eight feet above the ground and have a width that spans at least the horizontal length of the slide 106 between the slide upper end 114 and the slide lower end 116. By extending above the slide, the first wall 102 and the second wall 104 may increase the available climbing surface and may also provide the user with the experience of sliding through a canyon like structure.

In an alternative embodiment, the first wall 102 and the second wall 104 may extend to the top surface of slide 106. For example, as the slide 106 descends from the slide upper end 114 to the slide lower end 116, the top of the first wall 102 and the top of the second wall 106 may match the descending incline of the slide 106. Further, the first wall 102 and the second wall 106 may both extend above the slide 106 and match the descending incline of the slide 106. For example, the first wall 104 and the second wall 106 may extend to a point several inches above the slide 106 and the top of the first wall 104 and the top of the second wall 106 may match the descending incline with the slide 106. By extending several inches above the slide 106, the first wall 102 and the second wall 104 may prevent users from falling off the slide while descending. Further, when the first wall 102 and the second wall 104 match the descending incline of the slide 106, the user may access the slide at a point between the slide upper end 114 and the slide lower end 116 and may create walls of varying heights that would allow children of different ages to enjoy the bouldering slide 100. In a further embodiment, the first wall 102 and the second wall 104 may horizontally span a portion of the slide 106. For example, the first wall 102 and the second wall 104 may horizontally span half of the slide 106.

In at least one embodiment, the slide 106 may be constructed of material that allows a user to rapidly descend between from the slide upper end 114 and the slide lower end 116. For example, the slide 106 may be constructed of polished metal, plastic, fiberglass, and the like. In a further embodiment, the slide may be constructed of the same material as the first interior surface (not shown in FIG. 1A but illustrated in subsequent figures) and the second interior surface 120. In an alternative embodiment, the slide 106 may be constructed from a material that has less friction than the first interior surface and the second interior surface 120. As a user goes down the slide, the first interior surface and the second interior surface 120 may help the user control their speed as they descend down the slide 106.

In a further embodiment, the slide 106 may descend at a uniform slope from the slide upper end 114 towards the slide lower end 116. For instance, the slide 106 may be straight with no variation in the slope between the slide upper end 114 and the slide lower end 116. In an alternative embodiment, the slope of the slide 106 may vary between the slide upper end 114 and the slide lower end 116. For example, the slope of the slide 106 may increase as the user approaches the slide lower end 116. Conversely, the slope of the slide 106 may decrease as the user approaches the slide lower end 116. In another example of a slide with a varying slope, the slide 106 may have a series of wave and dips between the slide upper end 114 and the slide lower end 116. Further, the direction of the slide 106 may zigzag between the slide upper end 114 and the slide lower end 116.

In certain embodiments, the bouldering slide 100 may further include a tunnel 110 that passes under the slide 106 and allows a user to move from the first wall 102 to the second wall 104 without having to go around the bouldering slide 100. For example, the tunnel 110 may be a hole that extends between the first wall 102 and the second wall 104. In a further example, the tunnel 110 may be an archway that connects the first wall 102 and the second wall 104. The tunnel 110 may be surrounded by a wall that is covered with climbing holds 112, increasing the diversity of climbing surfaces on the bouldering slide 110. Alternatively, the tunnel may augment the experience of the user by providing a cave like feature under the slide 106. For example, the tunnel 110 may extend beneath the slide 106 and between the first wall 102 and the second wall 104. The tunnel 110 may add to the diversity of available experiences and the enjoyment of the bouldering slide 100.

In at least one embodiment, the structure of the tunnel 110 may support the slide 106. For example, the access mechanism 114 may support the slide upper end 114 and the ground may support the slide lower 116. To increase the structural support for the slide 106 through the middle portion of the bouldering wall 100, the tunnel 110 may provide vertical support to prevent the slide 106 from sagging or breaking during use.

In a further embodiment, the first wall 102 and the second wall 104 may be covered with climbing holds 112. The term "climbing holds," as used herein, refers to shaped grips that a user can use to support their weight by holding onto or stepping on the shaped grips. The climbing holds 112 may be constructed from a material that is strong enough to support the weight of a user and durable enough to stay attached to the first wall 102 and the second wall 104 for an extended period of time without breaking. For example, the climbing holds 112 may be constructed from rock, wood, resin, fiberglass, urethane, hard plastic, etc. Further, the climbing holds 112 may include several different types of climbing holds. For example, the climbing holds 112 may include footholds, handholds, jugs, pinches, crimps, and the like.

In certain embodiments, the climbing holds 112 may be uniformly distributed on the exterior climbing surfaces of the first wall 102 and the second wall 104. Alternatively, the climbing holds 112 may be strategically placed on the exterior climbing surfaces of the first wall 102 and the second wall 104. For example, the exterior climbing surfaces of the first wall 102 and the second wall 104 may include routes that are specifically designed for different rock climbing skill levels. Younger users may use the easier routes while more advanced users may use the challenging routes. In a further embodiment, the easiest route up the bouldering wall may include the access mechanism 108. For example, large, easily graspable hand and foot holds may be evenly spaced and close together on a third wall that facilitates access to the slide upper end 114. In various embodiments, the slide 100 may include one or more anchor points and other related equipment (not shown) to secure ropes or other safety equipment to a user. For example, an anchor point may be used to belay a climber.

In at least one embodiment, the bouldering slide 100 may include one or more access mechanisms 108 to provide access to the slide upper end 114. The term "access mechanism," as used herein, generally refers to an apparatus that aids a user as they move from the bottom of the bouldering slide 100 to the slide upper end 114. For example, an access mechanism 108 may be a third wall composed of the same material as the first wall 102 and the second wall 104. The third wall may be covered with climbing holds 112. A user can ascend the access mechanism 108 using the climbing holds 112 to reach the slide upper end 114. Alternatively, an access mechanism 108 may include a ladder, a series of steps, a rope, a pole, a cargo net, a rope ladder and the like. In at least one example, a series of playground equipment may be used to access the slide upper end 114. For example, a platform connected to a series of traditional playground equipment may abut against the bouldering slide 100 at the same height as the slide upper end 114. In at least one embodiment, an access mechanism 108 may be designed for a specific child age group. For example, stairs may more easily provide access for a younger child than a rope, and the access mechanism 108 may be designed according to the age group that is expected to use the bouldering slide 100.

Figure 1B:
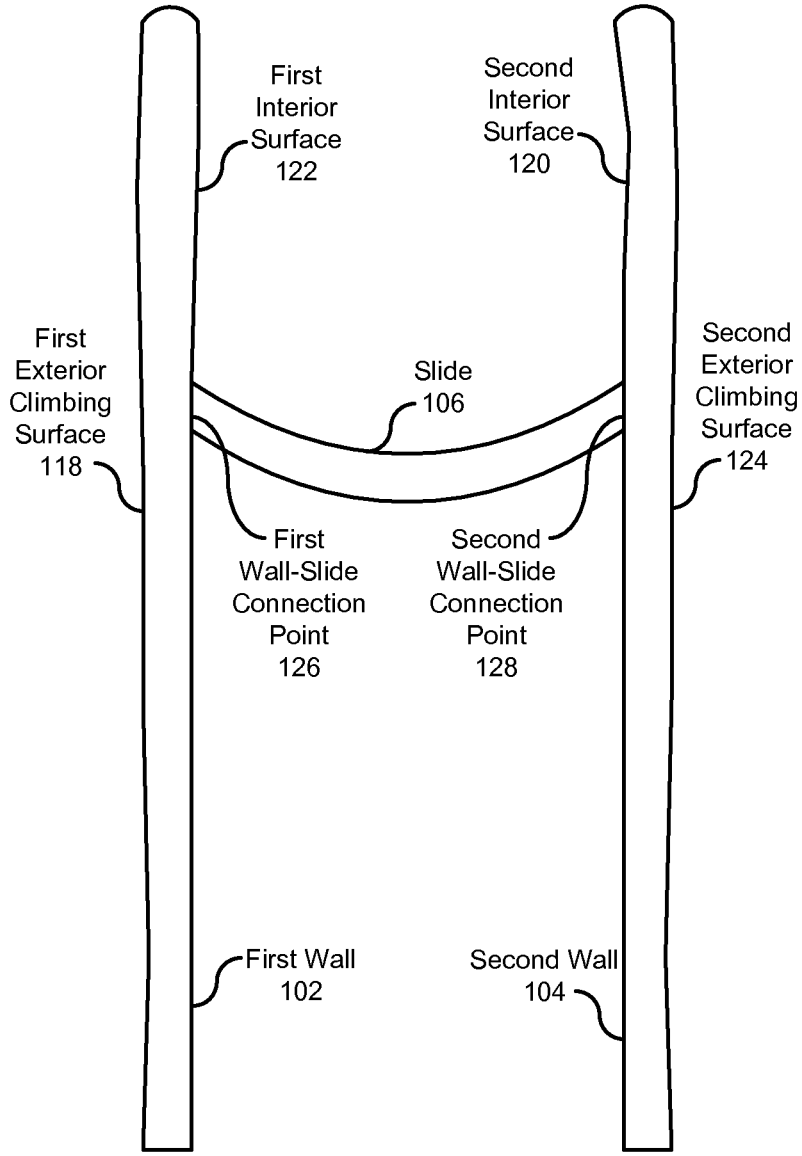
FIG. 1B is a cross section view further illustrating the bouldering slide of FIG. 1A in accordance with the present invention.

FIG. 1B depicts a cross section of the bouldering slide 100. The cross section illustrates the first wall 102, the second wall 104, and the slide 106 according to at least one embodiment. The first wall 102 may include a first exterior climbing surface 118 and a first interior surface 122. The second wall 104 may include a second exterior climbing surface 124 and a second interior surface 120. The first wall 102 may connect to the slide 106 at a first wall-slide connection point 126 and the second wall 104 may connect to the slide 106 at a second wall-slide connection point 128.

In certain embodiments, the first wall 102 and the second wall 104 may be constructed of a material that can support the weight of the user and/or that can be exposed to outdoor weather for extended periods of time. For example, the first wall 102 and the second wall 104 may be constructed from wood, metal, plastic, a composite material, a ceramic, concrete, cinderblock, fiberglass, and the like. The first wall 102 and the second wall 104 may be constructed as a single piece or as several pieces that are assembled at the location of the bouldering slide 100. For example, where the first wall 102 and the second wall 104 are constructed of fiberglass or plastic, the first wall 102 and the second wall 104 may be installed at the location as a single piece. Alternatively, where the first wall 102 and the second wall 104 are constructed of concrete or cinderblock, the first wall 102 and the second wall 104 may be constructed on site.

In at least one embodiment, the first wall 102, the second wall 104, the slide 106, and the access mechanism 114 in FIG. 1A may be constructed as a single manufactured piece. For example, at the time of manufacture, the first wall 102, the second wall 104, the slide 106, and the access mechanism 114 may be molded out of a plastic to form a single manufactured piece. In an alternative embodiment, the first wall 102, the second wall 104, the slide 106, and the access mechanism 114 may be separately constructed and connected together at the installation location.

In a further embodiment, the first wall 102 and the second wall 104 may support the slide 106. For example, the first wall 102 and the second wall 104 may structurally support the slide 106 at the first wall-slide connection point 126 and the second wall-slide connection point 128. The slide 106 may be bolted into the first wall 102 and the second wall 104. Alternatively, the slide 106 may rest on slide supports that are attached to the first wall 102 and the second wall 104. Further, the slide 106 may also fit into designed grooves in the first wall 102 and the second wall 104.

In certain embodiments, the first wall 102 and the second wall 104 may attach to a pre-existing slide. For example, the first wall 102 and the second wall 104 may attach to the side of a freely standing slide 106. The first interior surface 122 and the second interior surface 120 abutting against the first-wall slide connections point 126 and the second wall-slide connection point 128. The first wall 102 and the second wall 104 may form bouldering walls on the sides of a slide, allowing a user to enjoy the benefits of bouldering and sliding in one space saving apparatus.

Figure 2A:
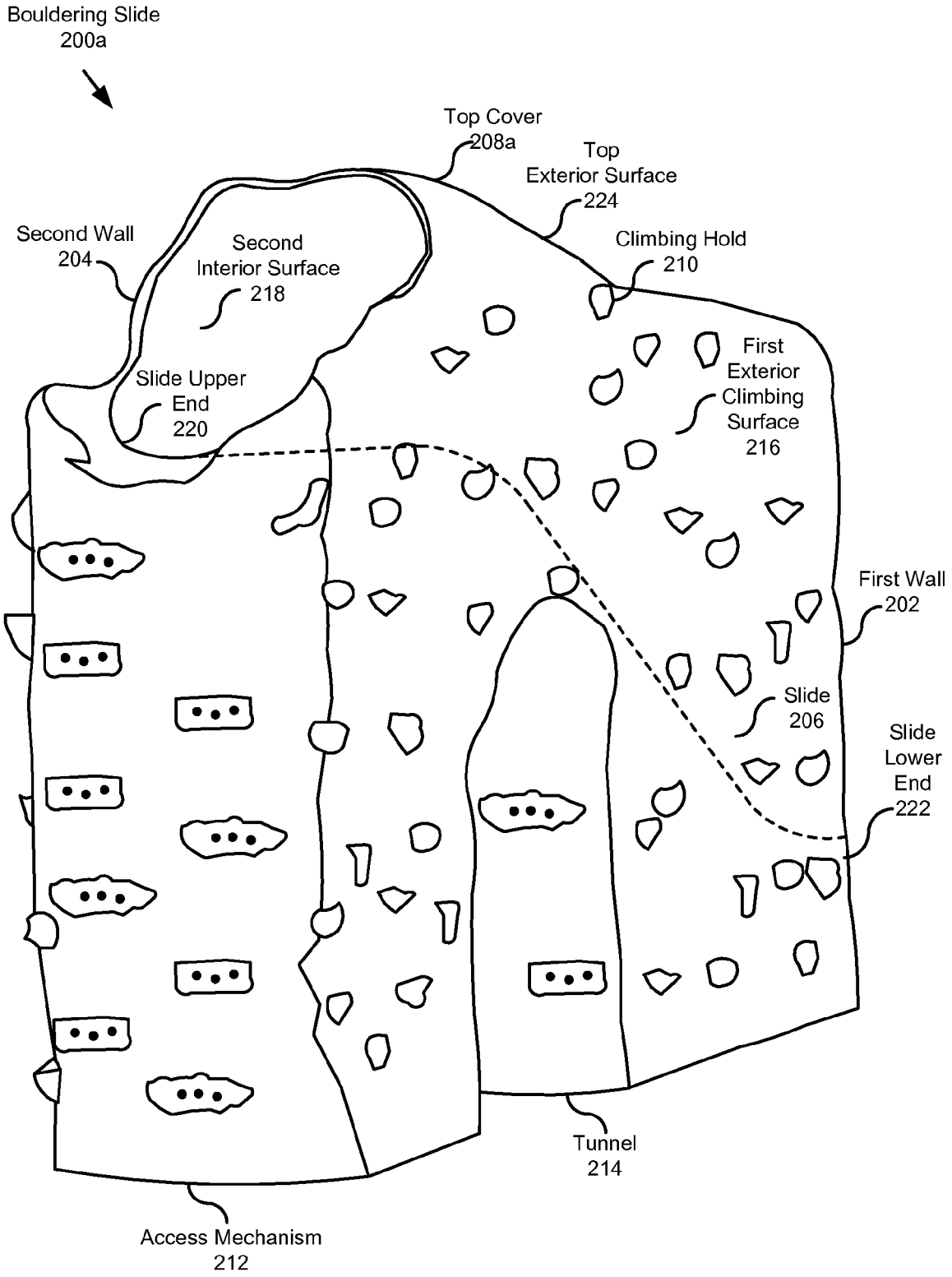
FIG. 2A illustrates one embodiment of a bouldering slide with a top cover in accordance with the present invention.

FIG. 2A depicts an embodiment of a bouldering slide 200*a*. The bouldering slide 200*a* may include a first wall 202, a second wall 204, a slide 206, a top cover 208*a*, a climbing hold 210, an access mechanism 212, and a tunnel 214. The first wall 202 may further comprise a first exterior surface 216. The second wall 204 may also include a second interior surface 218. The top cover 208*a* may include a top exterior surface 224 that faces away from the sliding surface. The slide 206 may comprise a slide upper end 220 and a slide lower end 222. The bouldering slide 200*a* is similar to the bouldering slide 100 in FIG. 1A, except the bouldering slide 200*a* may include a top cover 208*a*.

The top cover 208*a* may include a surface that covers the slide 206, and may also connect the top of the first wall 202 with the top of the second wall 204. The top cover 208*a* may cover a portion of the slide 206 but may leave the slide upper end 220 uncovered so that a user has room to mount the slide 206 for descending down the slide 206. For example, the top cover 208*a* may cover the portion of the slide 206 that descends from the slide upper end 220 towards the slide lower end 222.

In at least one embodiment, the top cover 208*a* may provide an alternative way to access the slide upper end 220. For example, a user may ascend the first wall 202 at a proximate location to the slide lower end 222. After the user reaches the top cover 208*a*, the user may move along the top cover 208*a* towards the slide upper end 220. Further, climbing holds may cover the top exterior surface 224 of the top cover 208*a* allowing a user to more securely move along the top cover 208*a*.

Figure 2B:
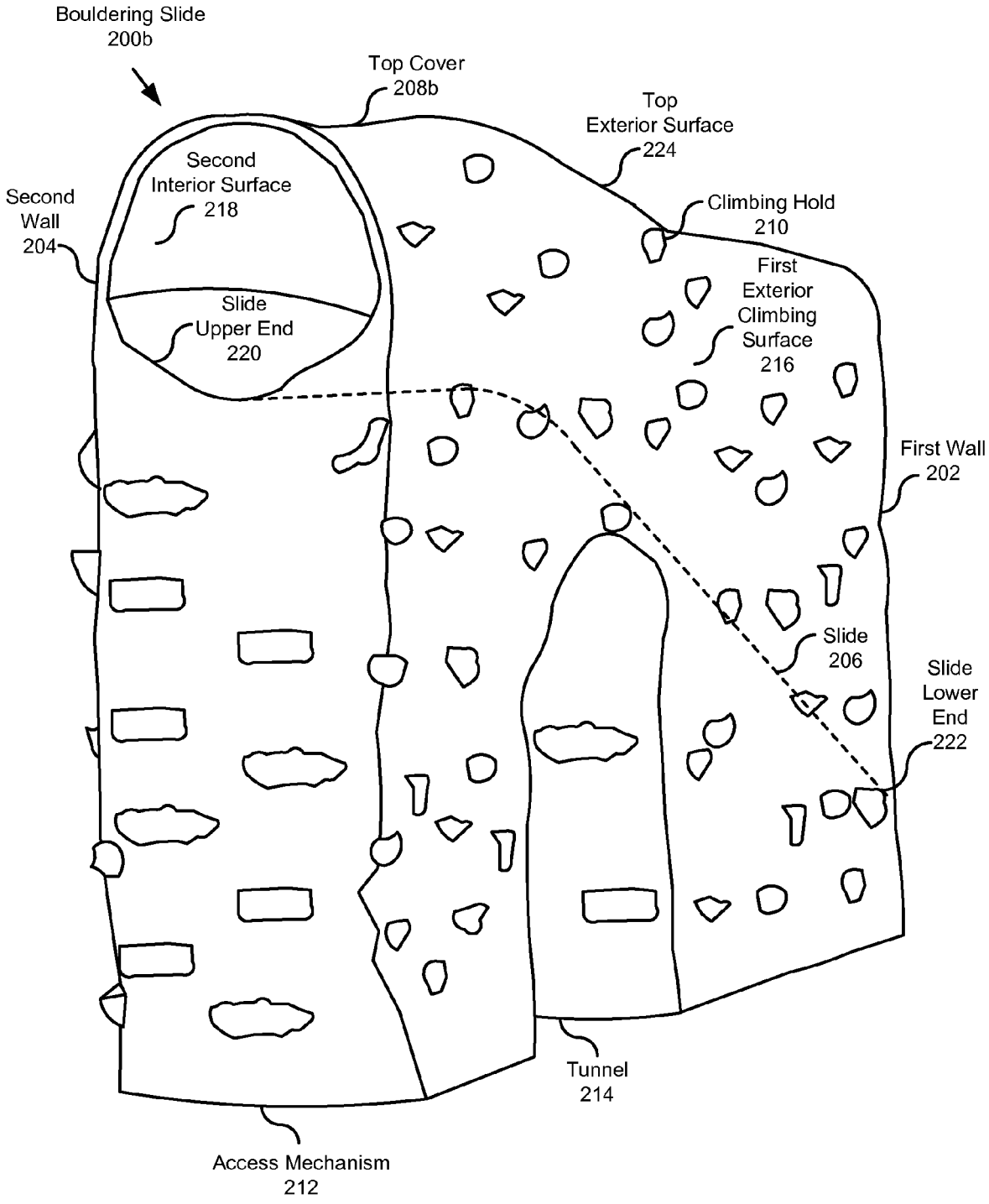
FIG. 2B illustrates one embodiment of a bouldering slide with a top cover in accordance with the present invention.

FIG. 2B depicts an alternative embodiment of a bouldering slide 200*b*. The bouldering slide 200*b* may be similar to the bouldering slide 200*a* in FIG. 2A but the bouldering slide 200*b* may further include a top cover 208*b* that extends over the full length of the bouldering slide 200*b*. For example, the top cover 208*b* of the bouldering slide 200*b* may fully cover the slide upper end 220. Further, in certain embodiments, the top cover 208*b* may extend over the access mechanism 212. By extending over the full length of the bouldering slide 200*b*, the top cover 208*b* may protect the slide from weather effects like rain, snow, and ice. In one embodiment, the top cover 208*a* in FIG. 2A is shaped to partially cover the slide 206 such that the overall height of the bouldering slide 200*a* is less than the bouldering slide 200*b* and top cover 208*b* depicted in FIG. 2B that extends over more of the slide 206.

Figure 2C:
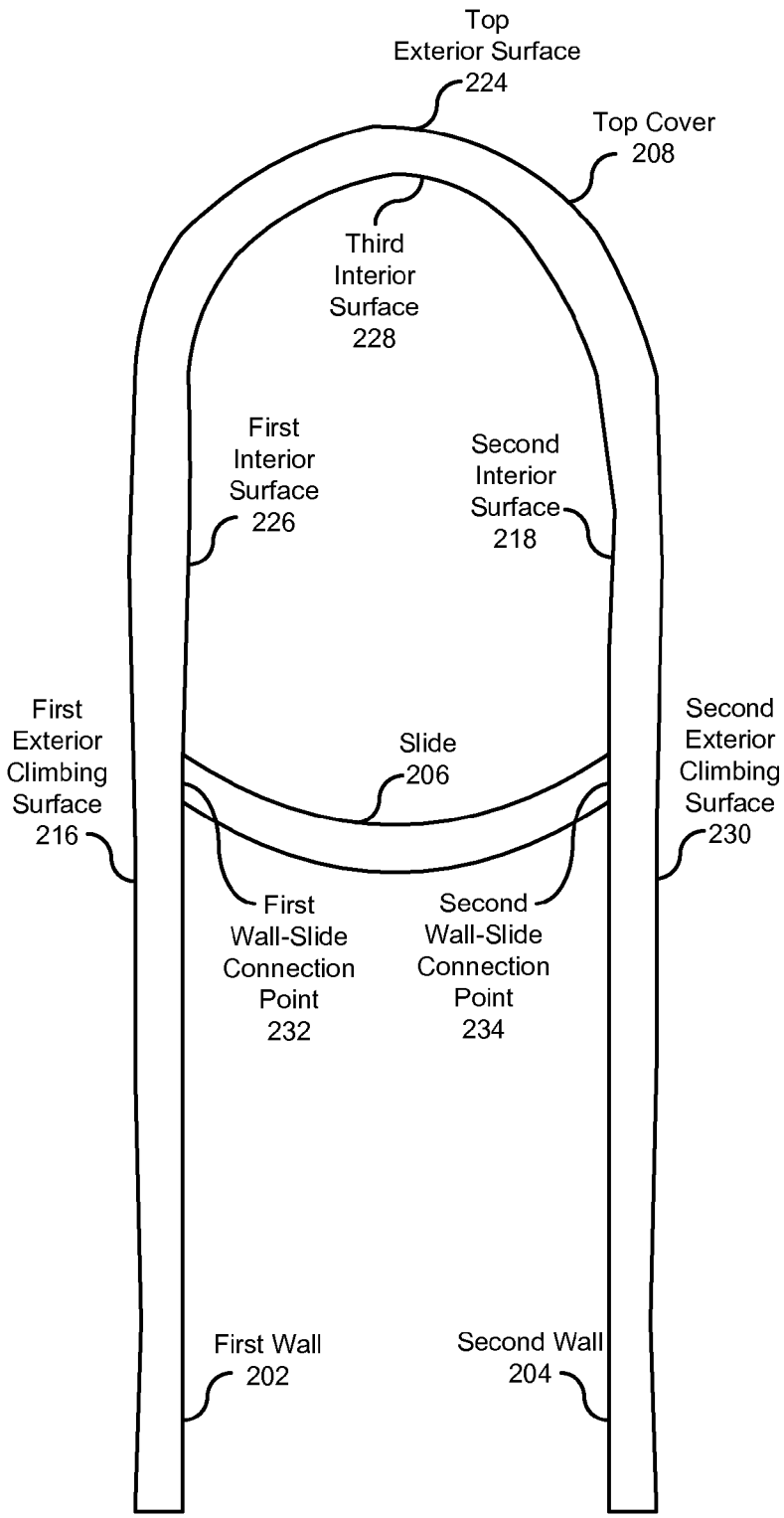
FIG. 2C is a cross section view further illustrating the bouldering slide of FIG. 2A and FIG. 2B in accordance with the present invention.

FIG. 2C depicts a cross section of the bouldering slide 200*a* and the bouldering slide 200*b*. The cross section illustrates the first wall 202, the second wall 204, the slide 206, and the top cover 208 according to at least one embodiment. The first wall 202 may include a first exterior climbing surface 216 and a first interior surface 226. The second wall 204 may include a second exterior climbing surface 230 and a second interior surface 218. The first wall 202 may connect to the slide 206 at a first wall-slide connection point 232 and the second wall 204 may connect to the slide 206 at a second wall-slide connection point 234. Further, the top cover may cover the slide 206 and may include a top exterior surface 224 and a third interior surface 228, the third interior surface 228 may face toward the sliding surface. When the bouldering slide 200*a* and the bouldering slide 200*b* have a top cover 208*a*,

208*b*, the first wall 202 and the second wall 204 may function substantially similar to the first wall 102 and the second wall 104 in FIG. 1B.

In certain embodiments, the top cover 208 may connect to the first wall 202 and the second wall 204. By connecting to the first wall 202 and the second wall 204, the top cover 208 may provide or increase the lateral support to the first wall 202 and the second wall 204. For example, the first wall 202 and the second wall 204 may be anchored to the ground, the slide 206 may provide some lateral support to the first wall 202 and the second wall 204 at the first wall-slide connection point 232 and the second wall-slide connection point 234. Further, the top cover 208 may provide some lateral support to the first wall 202 and the second wall 204 at the top of the first wall 202 and the second wall 204.

In at least one embodiment, the top cover 208 may be constructed from the same material as the first wall 202 and the second wall 204. For example, the top cover may be constructed from a wood, metal, plastic, a composite material, a ceramic, concrete, cinderblock, fiberglass, and the like, similar to the materials that may be used for the first wall 202 and the second wall 204. In a further embodiment, the top cover 208 may be constructed from different materials than those used to construct the first wall 202 and the second wall 204. For example, where the first wall 202 and the second wall 204 are constructed with concrete, the top cover may be constructed from a plastic, metal, wood, composite material, ceramic and the like.

In certain embodiments, the first wall 202, the second wall 204, the slide 206, the top cover 208, and the access mechanism 212 in FIG. 2A may be constructed as a single manufactured piece. For example, at the time of manufacture, the first wall 202, the second wall 204, the slide 206, the top cover 208, and the access mechanism 212 may be molded out of a plastic to form a single manufactured piece. In an alternative embodiment, the first wall 202, the second wall 204, and the top cover 208 may be formed independently from the slide 206. For example, the first wall 202, the second wall 204, and the top cover 208 may be a preformed shell that slides or installs over the slide 206.

In a further embodiment, the top cover 208 may allow the user to experience sliding through a tunnel. For example, the first interior surface 226, the second interior surface 218, and the third interior surface 226 may connect together through a portion of the length of the slide 206. As a user descends down the slide 206, the first interior surface 226, the second interior surface 218, and the third interior surface 226 may fully encircle the user, providing the user with the experience of sliding through a tunnel.

Figure 3:
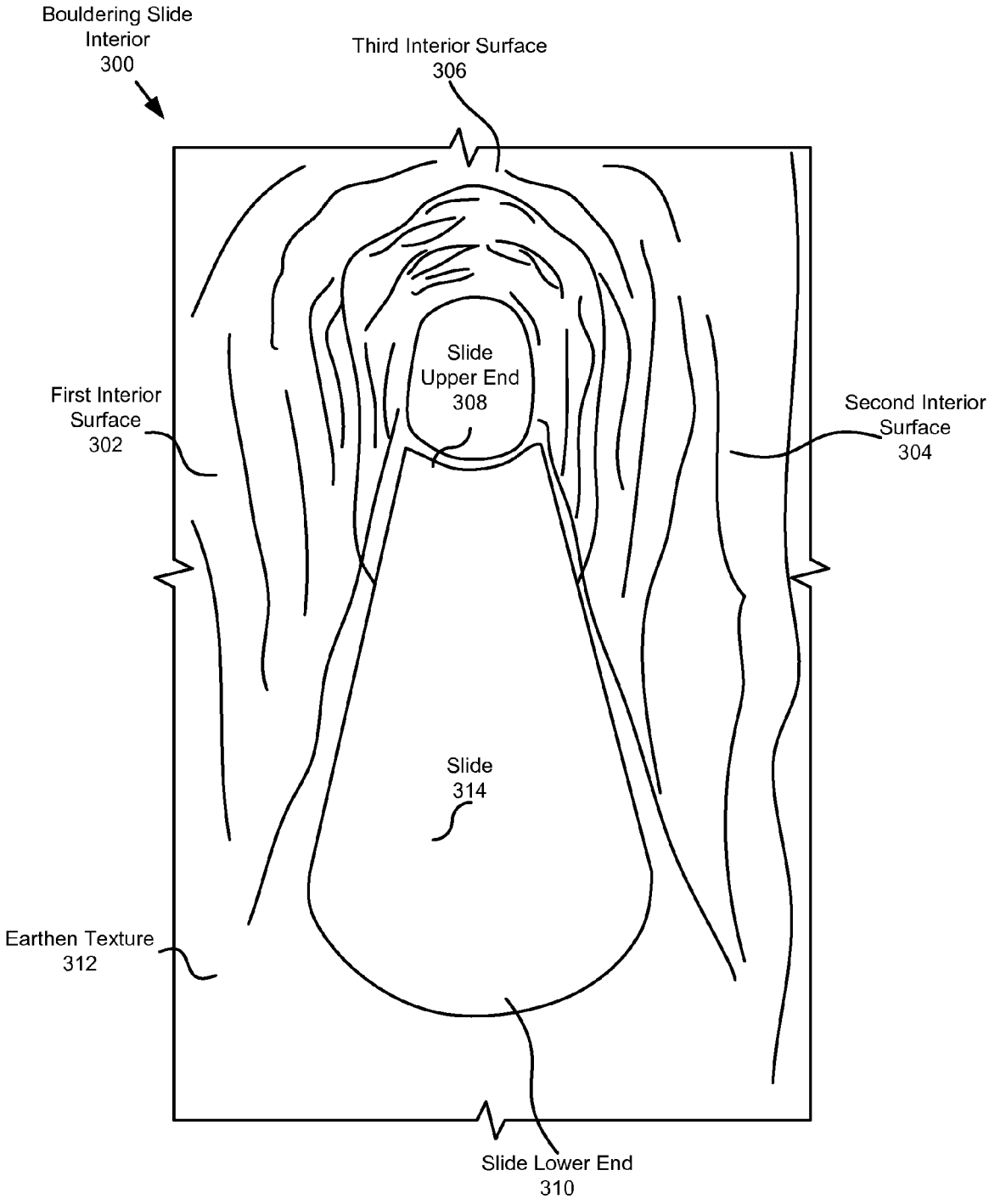
FIG. 3 illustrates the interior of a bouldering slide in accordance with the present invention.

FIG. 3 illustrates a bouldering slide interior 300 according to at least one embodiment. The bouldering slide interior 300 may include a first interior surface 302, a second interior surface 304, a third interior surface 306, a slide 314, a slide upper end 308, and a slide lower end 310, which are substantially similar to those described above. In at least one embodiment, the first interior surface 302, the second interior surface 304, and the third interior surface 306 are covered with an earthen texture 312.

In certain embodiments, as the first interior surface 302, the second interior surface 304, and the third interior surface 306 may surround the user as the user descends the slide 314, the user may have the experience of sliding through a tunnel. To enhance the user's experience of sliding through a tunnel, the first interior surface 302, the second interior surface 304, and the third interior surface 306 may be covered with the earthen texture 312. The phrase "earthen texture," as used herein, may refer to a texture that simulates a texture found in nature. For example, the earthen texture 312 may simulate the texture of rock, sand, wood, vegetation, and the like. Further, the earthen texture 312 may be smooth. For instance, the first interior surface 302, the second interior surface 304, and the third interior surface 306 may be smooth. Alternatively, the earthen texture 312 may vary. For example, the first interior surface 302, the second interior surface 304, and the third interior surface 306 may have bumps and ridges along the length of the slide to simulate an earthen tunnel.

Figure 4:
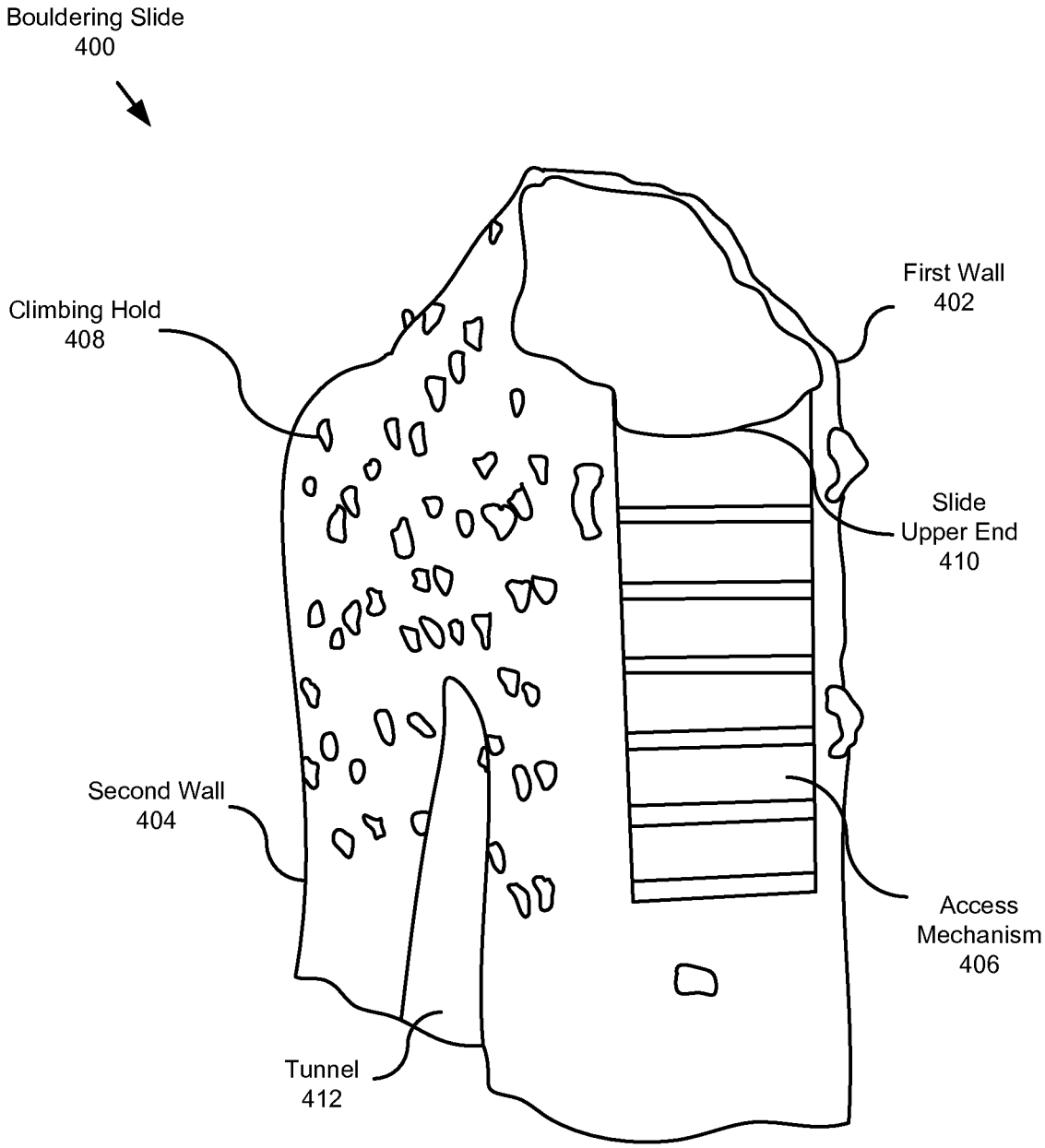
FIG. 4 illustrates an access mechanism for a bouldering slide in accordance with the present invention.

FIG. 4 illustrates an access mechanism 414 for a bouldering slide 400 according to at least one embodiment. The bouldering slide 400 may include a first wall 402, a second wall 404, an access mechanism 406, a climbing hold 408, a slide upper end 410, and a tunnel 412, which are substantially similar to those described above. The access mechanism 406 may allow a user to access the slide upper end 410. As was previously discussed the access mechanism 406 may allow the user to access the slide upper end 410 via a ladder, a series of steps, a rope, a pole, a cargo net, a rope ladder, a ramp, and the like. The bouldering slide 400 may include multiple access mechanisms 406.

In certain embodiments, where the user access the slide upper end 410 through a series of steps, the steps may rise vertically towards the slide upper end 410 with minimal horizontal variance. For example, the series of steps that provide access to the slide upper end 410 may be molded into a vertical wall. To increase the ability of a user to ascend a series of vertical steps, the access mechanism 406 may also include hand holds or rails that allow the user to pull themselves up the access mechanism 406. Alternatively, the series of steps may be inclined, allowing a user to access the slide upper end 410 through walking.

Figure 5:
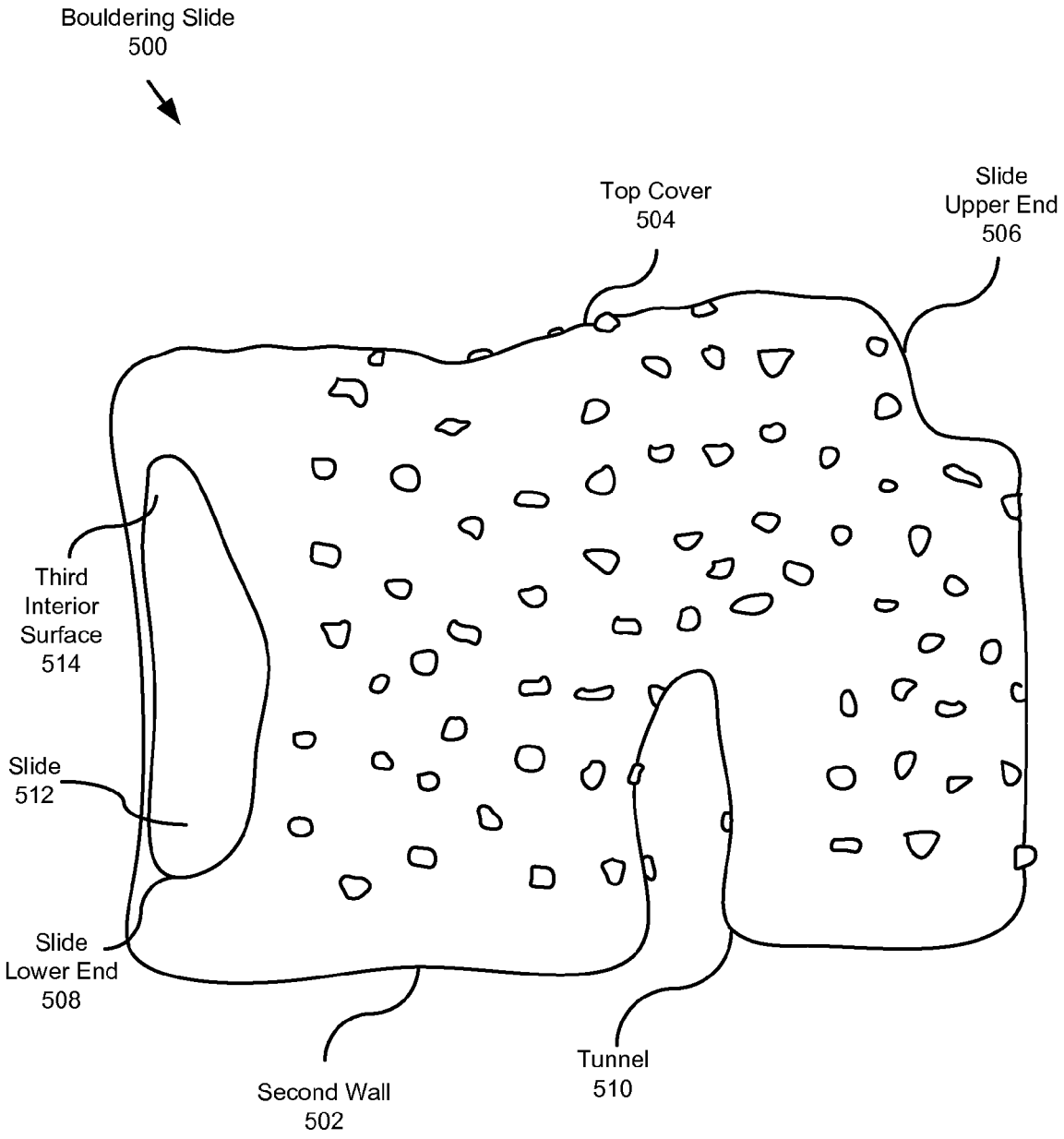
FIG. 5 illustrates a lower end of a bouldering slide in accordance with the present invention.

FIG. 5 illustrates a slide lower end 508 for a bouldering slide 500 according to at least one embodiment. The bouldering slide 500 may include a second wall 502, a top cover 504, a slide upper end 506, the slide lower end 508, and a tunnel 510, which are substantially similar to those described above. In certain embodiments, the third interior surface 514 may extend horizontally over the slide 512 as the slide 512 descends from the slide upper end 506 towards the slide lower end 508. As the user slides down the slide 512, the distance between the slide 512 and the third interior surface 514 may increase. Alternatively, the third interior surface 514 may slope downward as the slide 512 descends from the slide upper end 506 towards the slide lower end 508. For example, the distance between the slide 512 and the third interior surface 514 may stay constant as the user goes down the slide 512.

Figure 6:
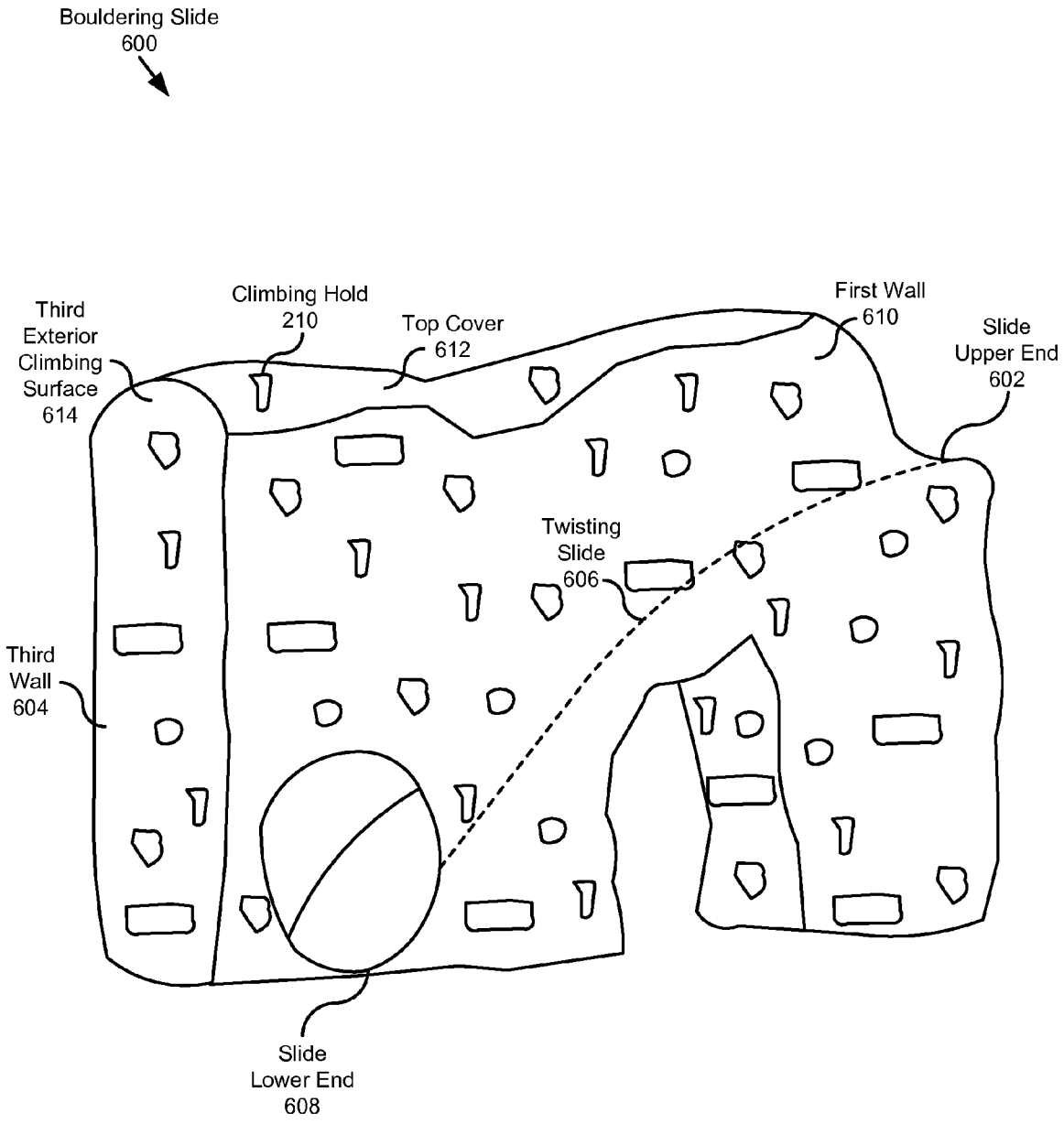
FIG. 6 illustrates a curving bouldering slide in accordance with the present invention.

FIG. 6 illustrates a bouldering slide 600 and a twisting slide 606 according to at least one embodiment. The bouldering slide 600 may include a slide upper end 602, a third wall 604, the twisting slide 606, a slide lower end 608, and a first wall 610. The term "twisting slide" 606, as used herein, may refer to a slide that changes direction as it descends from the slide upper end 602 towards the slide lower end 608. In certain embodiments, the slide lower end 608 may be located on the first wall 610. Alternatively, the slide lower end 608 may be located on the second wall 502 in FIG. 5. For example, as the user descends the twisting slide 606, the twisting slide 606 may curve and change the direction of the descent, causing the user to exit the twisting slide 606 on a wall adjacent to the slide upper end 602. In an alternative embodiment, the twisting slide 606 may spiral around and exit through either the first wall 610, the second wall 502, the third wall 604, or below the slide upper end 602. In at least one embodiment, the area of the top cover 612 may be widened to allow the twisting slide 606 to rotate within the bouldering slide 600.

In certain embodiments, the bouldering slide 600 may include a third wall 604. The third wall may include a third exterior climbing surface 614 and may be covered with climbing holds 616. The third wall 604 may connect to the first wall 610, and the second wall 204 in FIG. 2A. Further, in embodiments of the bouldering slide 600 that include a top cover 612, the third wall 604 may also connect to the top cover. The third wall 604 may increase the surface area available to a user for climbing.

Figure 7:
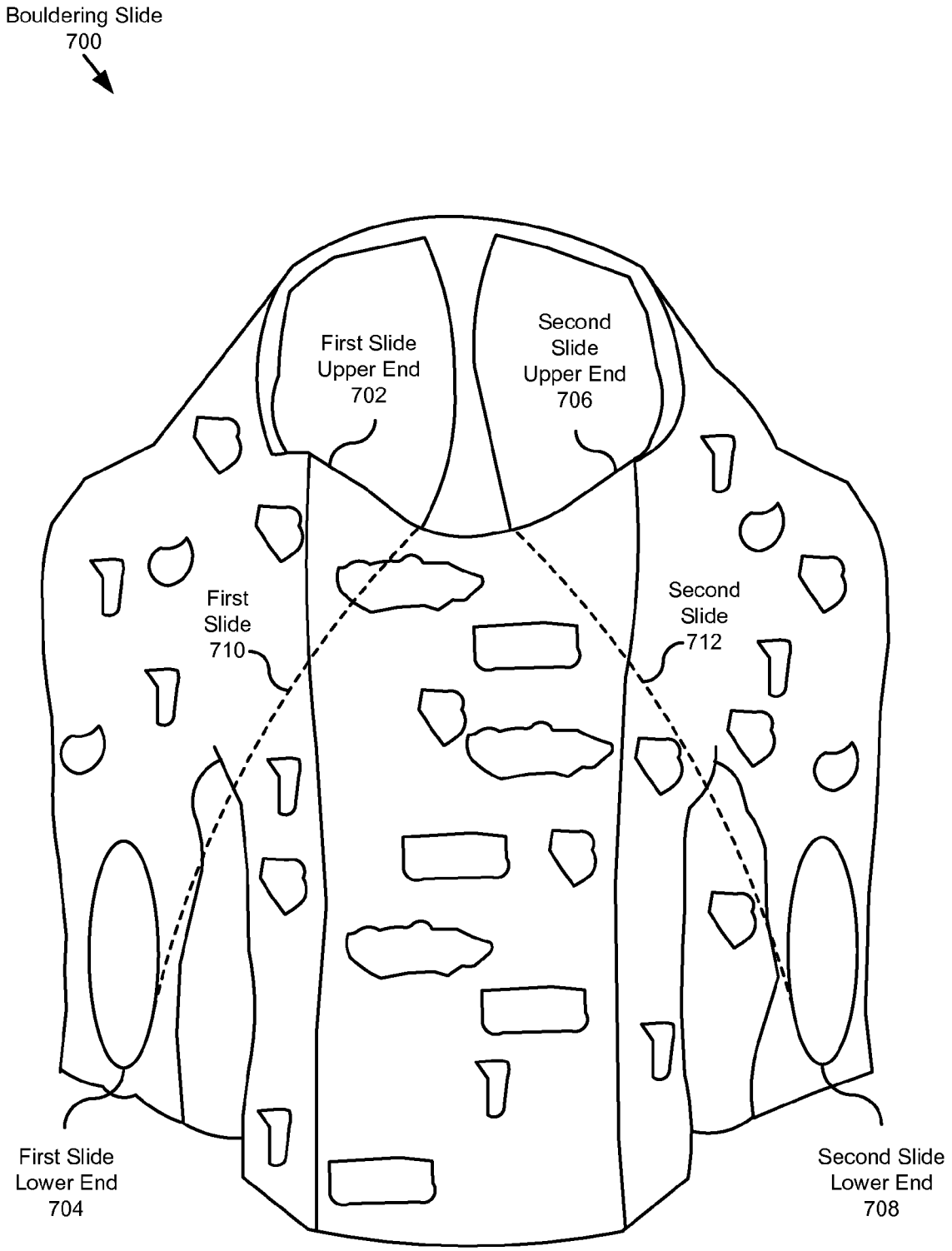
FIG. 7 illustrates a double bouldering slide in accordance with the present invention.

FIG. 7 illustrates a bouldering slide 700 that contains a first slide 710 and a second slide 712 according to at least one embodiment. The first slide 710 may include a first slide upper end 702 and a first slide lower end 704. The second slide 712 may include a second slide upper end 706 and a first slide lower end 708, which are substantially similar to those described above.

In certain embodiments, as the user ascends the access mechanism, they may have the opportunity to choose between a first slide 710, and a second slide 712. The first slide 710 may descend between the first slide upper end 702 and the first slide lower end 704. The second slide 712 may descend between the second slide upper end 706 and the second slide lower end 708. In one embodiment, the second slide lower end 708 and the first slide lower end 704 may be positioned on opposite sides of the bouldering slide 700. In another embodiment, the first slide lower end 704 and the second slide lower end 708 may be positioned on the third wall 604 in FIG. 6. For example, the first slide 710 and the second slide 712 may run parallel to one another as they descend from the first slide upper end 702 and the second slide upper end 706 towards the first slide lower end 704 and the second slide lower end 708.

In a further embodiment, the first slide upper end 702 and the second slide upper end 706 may be positioned on opposite sides of the bouldering slide 700. For example, the third wall 604 in FIG. 6 may function as an access mechanism to the second slide upper end 706, and the opposite side of the bouldering slide 700 may function as an access mechanism to the first slide upper end 702. Alternatively, the first slide upper end 702, and the second slide upper end 706 may be positioned on adjacent sides of the bouldering slide 700.

Figure 8A:
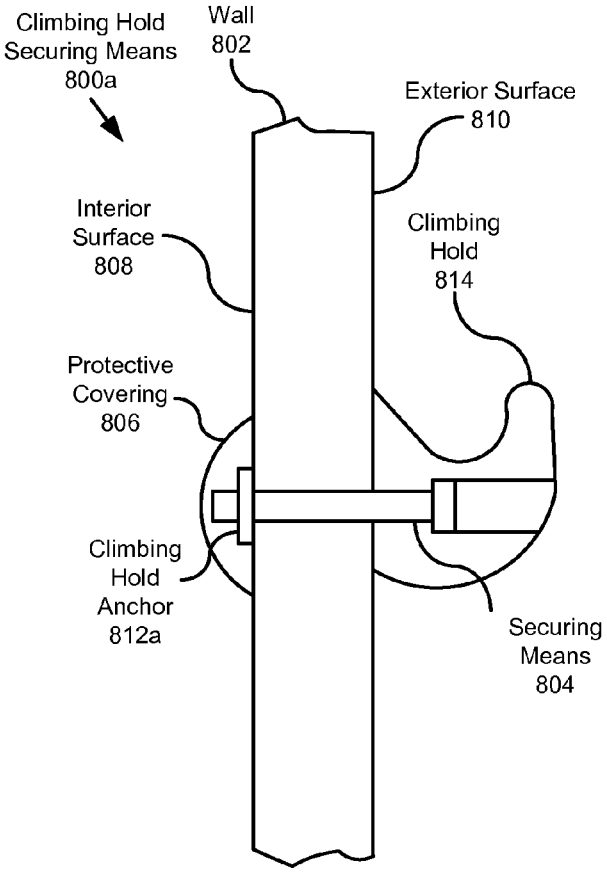
FIG. 8A illustrates a climbing hold anchor that extends through a wall in accordance with the present invention.

FIG. 8A illustrates a climbing hold securing means 800*a*. The climbing hold securing means 800*a* may include a wall 802, a securing means 804, a protective covering 806, an interior surface 808, an exterior surface 810, climbing hold anchor 812*a*, and a climbing hold 814.

In certain embodiments, the climbing hold securing means 800*a* may secure a climbing hold 814 to the interior surface 810 of the wall 802. The securing means 804 may extend through the climbing hold 814 and the wall 802 where a climbing hold anchor 812*a* may secure the climbing hold 814 to the wall 802. For example, a bolt may pass through the climbing hold 814 and extend through the wall 802. After the bolt has passed through the wall 802, a nut and washer may be tightened against the interior surface 808, securing the climbing hold 814 to the wall 802. As the securing means 804 extends past the interior surface 808 of the wall 802, a protective covering 806 may be placed over the climbing hold anchor 812*a* to protect a user who passes by the interior surface 808. For example, a plastic or rubber cap may be placed over a nut and bolt to protect a user who is near the interior surface 808 from getting cut or scratched on the exposed nut and bolt.

Figure 8B:
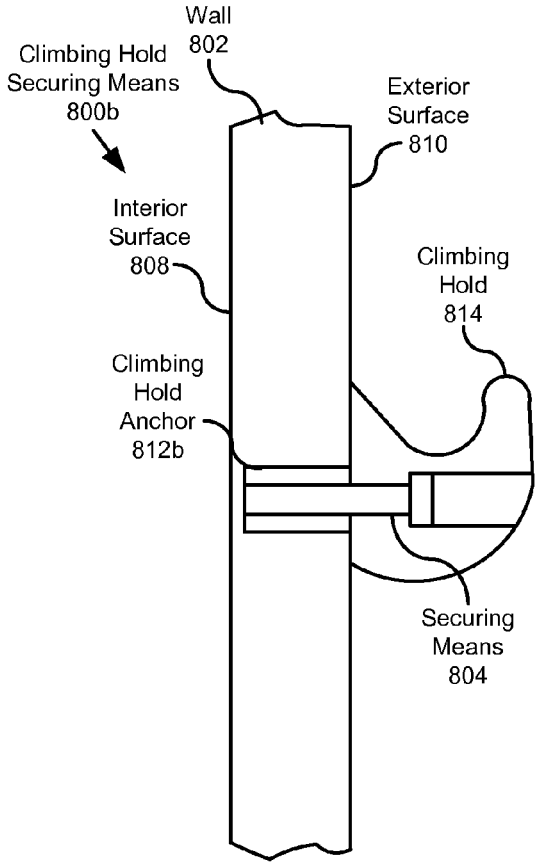
FIG. 8B illustrates a climbing hold anchor that extends into a wall in accordance with the present invention.

FIG. 8B illustrates another climbing hold securing means 800*b*. The climbing hold securing means 800*b* may include a wall 802, a securing means 804, an interior surface 808, an exterior surface 810, a climbing hold anchor 812*b*, and a climbing hold 814.

In certain embodiments, the climbing hold securing means 800*a* may secure a climbing hold 814 to the interior surface 810 of the wall 802. The securing means 804 may extend through the climbing hold 814 and into the wall 802, where a climbing hold anchor 812*a* may secure the climbing hold 814 to the wall 802. For example, a t-nut may be placed in the wall 802. A bolt may pass through the climbing hold 814 and be screwed into the t-nut. The t-nut may secure the climbing hold 814 to the wall 802. Alternatively, screws or nails may secure the climbing hold 814 to the wall 802.

The bouldering slide described in the present disclosure allows a user to more fully enjoy a playground. The bouldering slide saves space in a playground while allowing a user to get physical exercise while enjoying the unique fun offered by bouldering.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for recreation, the apparatus comprising:

a first wall having a first interior surface and a first exterior climbing surface;

a second wall having a second interior surface and a second exterior climbing surface;

a slide having a sliding surface, the sliding surface comprising an upper end and a lower end distal to the upper end, the upper end at a height above the lower end, the sliding surface positioned between the first wall and the second wall and descending between the first wall and the second wall, the sliding surface connecting to the first interior surface and to the second interior surface wherein the first wall and the second wall substantially cover sides of the slide and the first interior surface and the second interior surface each forming a wall on each side of the sliding surface and above the sliding surface from substantially the upper end to substantially the lower end of the slide, the upper end of the sliding surface connecting adjacent to an upper end of the first wall and the second wall, and the lower end of the sliding surface connecting adjacent to a lower end of the first wall and the second wall; and a plurality of climbing holds, the plurality of climbing holds being secured to the first exterior climbing surface and to the second exterior climbing surface.

2. The apparatus of claim 1, further comprising a top cover, the top cover having a third interior surface facing inward towards the sliding surface and a top exterior surface facing outward away from the sliding surface, the top cover connecting to the first wall and to the second wall, the top cover covering at least a portion of the slide.

3. The apparatus of claim 2, wherein the top exterior surface of the top cover comprises a portion of the plurality of climbing holds.

4. The apparatus of claim 2, wherein the top cover covers the slide forming a tunnel between the first wall and second wall and beneath the top cover.

5. The apparatus of claim 2, wherein the top cover covers the slide except a portion of the slide at the upper end used to mount the slide just prior to sliding down the slide.

6. The apparatus of claim 1, further comprising an access mechanism that aids a user in accessing the upper end of the slide.

7. The apparatus of claim 6, wherein the access mechanism comprises one or more of:

a plurality of climbing holds on a climbing surface;

a ladder;

a plurality of steps;

a rope;

a pole;

a cargo net; and a rope ladder.

8. The apparatus of claim 1, wherein the slide curves between the upper end and the lower end of the slide.

9. The apparatus of claim 1, wherein a tunnel passes under the slide connecting the first wall and the second wall.

10. The apparatus of claim 1, further comprising a securing means for securing each climbing hold of the plurality of climbing holds to the first exterior climbing surface and the second exterior climbing surface, wherein a securing means adjacent to where a slider passes the first wall and second wall is one or more of internal to the first wall or to the second wall and extends past the first interior surface or second interior surface such that a slider is not exposed to edges of the securing means when sliding past the securing means.

11. The apparatus of claim 10, wherein the securing means comprises one or more of:

a t-nut;

a screw;

a bolt; and a protective covering for preventing access to the securing means from the first interior surface and the second interior surface.

12. The apparatus of claim 1, wherein the slide comprises two or more slides and wherein the two or more slides are between the first wall and second wall.

13. The apparatus of claim 1, further comprising at least a third wall, each wall having an exterior climbing surface.

14. The apparatus of claim 13, wherein a third wall one of:

connects the first wall and the second wall;

connects to a top cover;

provides an access mechanism to aid a user in accessing the upper end of the slide; and connects to two or more slides.

15. The apparatus of claim 1, wherein the first wall and second wall span at least a horizontal length between the upper end of the slide and the lower end of the slide.

16. The apparatus of claim 1, wherein the first wall and second wall span at least a vertical height between the upper end of the slide and the lower end of the slide.

17. The apparatus of claim 1, wherein the first wall and second wall are substantially rectangular.

18. The apparatus of claim 1, wherein the first wall and second wall provide structural support for the slide.

19. An apparatus for recreation, the apparatus comprising:

a first wall having a first interior surface and a first exterior climbing surface;

a second wall having a second interior surface and a second exterior climbing surface;

a slide having an upper end, a lower end, and a sliding surface descending between the first wall and the second wall, the sliding surface connecting to the first interior surface and to the second interior surface;

a top cover having a third interior surface facing inward towards the sliding surface and a top exterior surface facing outward away from the sliding surface, the top cover connecting to the first wall and to the second wall, the top cover covering at least a portion of the slide, wherein the top cover covers the slide forming a tunnel between the first wall and second wall and beneath the top cover; and a plurality of climbing holds, the plurality of climbing holds being secured to at least the first exterior climbing surface and to the second exterior climbing surface.

20. An apparatus for recreation, the apparatus comprising:

a first wall having a first interior surface and a first exterior climbing surface;

a second wall having a second interior surface and a second exterior climbing surface;

a slide having an upper end, a lower end, and a sliding surface descending between the first wall and the second wall, the sliding surface connecting to the first interior surface and to the second interior surface;

a top cover having a third interior surface facing inward towards the sliding surface and a top exterior surface facing outward away from the sliding surface, the top cover connecting to the first wall and to the second wall, the top cover covering at least a portion of the slide, wherein the top cover covers the slide forming a tunnel between the first wall and second wall and beneath the top cover; and;

a plurality of climbing holds, the plurality of climbing holds being secured to the first exterior climbing surface, to the second exterior climbing surface, and to the top cover; and further comprising an access mechanism that aids a user in accessing the upper end of the slide, wherein the access mechanism comprises one or more of a plurality of climbing holds on a climbing surface;

a ladder;

a plurality of steps;

a rope;

a pole;

a cargo net; and a rope ladder.

* * * * *